US009193511B2

(12) United States Patent
Graham

(10) Patent No.: US 9,193,511 B2
(45) Date of Patent: Nov. 24, 2015

(54) CARTON WITH DISPENSING HOLE

(71) Applicant: Tarah N. Graham, Atlanta, GA (US)

(72) Inventor: Tarah N. Graham, Atlanta, GA (US)

( * ) Notice: Subject to any disclaimer, the term of this patent is extended or adjusted under 35 U.S.C. 154(b) by 0 days.

(21) Appl. No.: 14/205,297

(22) Filed: Mar. 11, 2014

(65) Prior Publication Data

US 2014/0263601 A1 Sep. 18, 2014

Related U.S. Application Data

(60) Provisional application No. 61/778,310, filed on Mar. 12, 2013.

(51) Int. Cl.

| | |
|---|---|
| ***B65D 5/46*** | (2006.01) |
| ***B65D 77/06*** | (2006.01) |
| ***B65D 77/04*** | (2006.01) |
| ***B65D 5/02*** | (2006.01) |
| ***B65D 5/66*** | (2006.01) |

(52) U.S. Cl.

CPC ..... *B65D 77/067* (2013.01); *B65D 5/0227* (2013.01); *B65D 5/0254* (2013.01); *B65D 5/4604* (2013.01); *B65D 5/46024* (2013.01); *B65D 5/6608* (2013.01); *B65D 77/0426* (2013.01); *B65D 77/065* (2013.01); *B65D 77/068* (2013.01)

(58) Field of Classification Search

CPC ..... B65D 5/0254; B65D 5/46024; B65D 77/062; B65D 77/065; B65D 77/067; B65D 77/068; B65D 77/0426

See application file for complete search history.

(56) References Cited

U.S. PATENT DOCUMENTS

| | | | | |
|---|---|---|---|---|
| 2,190,433 | A * | 2/1940 | Palmer | 229/150 |
| 3,140,811 | A * | 7/1964 | Hall et al. | 229/117.15 |
| 3,499,582 | A * | 3/1970 | Berney | 222/183 |
| 4,171,763 | A * | 10/1979 | Card | 229/117.15 |
| 4,815,631 | A * | 3/1989 | Eeg et al. | 229/117.3 |
| 6,736,309 | B1 * | 5/2004 | Westerman et al. | 229/117.05 |
| 6,926,192 | B1 * | 8/2005 | Dowd | 229/117 |
| 8,011,533 | B2 * | 9/2011 | Reineccius et al. | 221/96 |
| 2003/0160092 | A1 * | 8/2003 | Philips et al. | 229/122.32 |
| 2006/0097005 | A1 * | 5/2006 | Hill et al. | 222/105 |

FOREIGN PATENT DOCUMENTS

| | | | | |
|---|---|---|---|---|
| FR | 2934575 | A1 * | 2/2010 | B65D 5/0254 |

* cited by examiner

*Primary Examiner* — Gary Elkins

(74) *Attorney, Agent, or Firm* — Minh N. Nguyen; Next IP Law Group LLP

(57) ABSTRACT

A paperboard blank for forming a carton for carrying a flexible plastic bag for holding a liquid product is provided. The carton has an aperture near the bottom of a side wall through which a dispensing mechanism of the bag can be extended. The carton has interlocking flaps for forming the bottom of the carton and fold lines for forming the various panels. The carton may have apertures in the top for the insertion of a handle. The rear wall of the carton has a locking flap for gluing or locking to the edge of left side wall to form the box structure. One of the walls has locking tabs at the top for insertion in locking slots on the edge of a top panel for holding the three top panels in place.

5 Claims, 14 Drawing Sheets

CARTON WITH DISPENSING HOLE

CROSS REFERENCE TO RELATED APPLICATIONS

This application claims the benefit of U.S. provisional application entitled, "CARTON WTH DISPENSING HOLE," having Ser. No. 61/778,310, filed on Mar. 12, 2013, all of which are entirely incorporated herein by reference.

TECHNICAL FIELD

The present disclosure is generally related to cartons with at least one dispensing hole that are useful in the packaging of products, such as, liquid detergents, in a plastic bag deployed inside the carton.

SUMMARY

The present disclosure starts with a paperboard blank for forming a carton for holding a flexible bag containing a liquid, the blank having a left top panel, center top panel and right top panel which are connected by a fold line to a left side wall, a front wall and right side wall respectively, the top panels having at least one aperture suitable for a handle on the flexible bag to be inserted through the apertures and secured so that the carton with the bag inside can be picked up and carried, there being an aperture in one of the side walls or front wall for the insertion of a pouring mechanism on the flexible bag, the front wall being connected to the right side wall and left side wall by fold lines, with a rear wall connected to the right side wall by a fold line, the rear wall having a top connected by a fold line to at least one locking flap, the right side wall, front wall, left side and rear wall having a bottom to which is attached at least one interlocking flap on each wall for forming the bottom of the carton, the rear wall having a locking flap attached to the side of the rear wall not attached to the right side wall by a fold line and with the center top panel having a locking flap foldably attached to the side of the center top panel opposite the fold line between the center top panel and the front wall.

This paperboard blank can easily be formed into a carton by folding various fold lines and locking locks in the paperboard or gluing a flap. This carton is designed for carrying a flexible bag for holding a liquid product, the carton having a left side wall, connected to a front wall by a fold line, with the front wall connected to a right side wall by a fold line, with the right side wall connected to the rear wall by a fold line, which in turn is connected to a locking flap by a fold line, with the left side wall having an outside edge which is attached to the locking flap by attaching means, with each of the walls having a top and bottom, with bottom of each flap attached to interlocking flaps by a fold line, with the interlocking flaps forming the bottom of the carton, with the left side wall attached at its top to a left top panel by a fold line, with the top of the front wall attached to the center top panel by a fold line, with the top of the right side wall attached to a right top panel by a fold line and the rear wall attached to a pair of locking tabs by a fold line, with the center top panel having a top attached to a flap by a fold line, with the flap having a pair of locking slots into which the locking tabs are secured, with left top panel, center top panel and right top panel being folded to form the top of the carton, with the bottom of one of the side walls having an aperture for receiving a dispensing mechanism on the bag.

BRIEF DESCRIPTION OF DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, the reference numerals designate corresponding parts throughout the several views. While several embodiments are described in connection with these drawings, there is no intent to limit the disclosure to the embodiment or embodiments disclosed herein. On the contrary, the intent is to cover all alternatives, modifications, and equivalents.

DETAILED DESCRIPTION

Disclosed are cartons 100 with at least one dispensing hole 201 and blanks 200 for erecting into cartons with at least one dispensing hole 201. The cartons 100 and blanks 200 disclosed can be constructed of single ply paperboard and/or recycled and ecofriendly cardboard, for example. For heavier loads, corrugated paperboard is preferred.

Exemplary cartons and blanks are discussed with reference to the figures. Although the cartons 100 and blanks 200 are described in detail, the cartons 100 and blanks 200 are provided for purposes of illustration only and various modifications are feasible.

Figure 1:
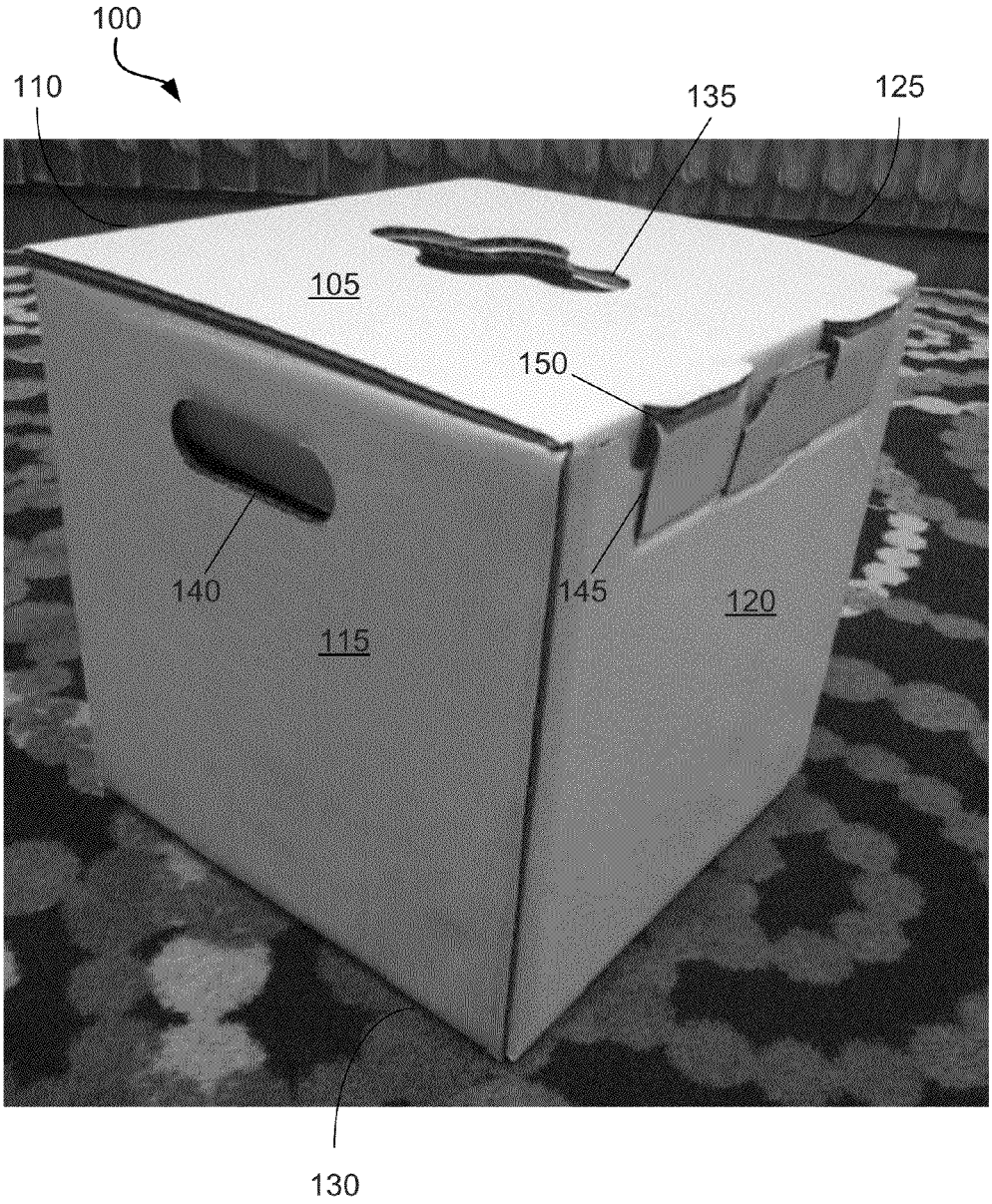
FIG. 1 is a perspective view of an embodiment of a carton with at least one dispensing hole in a closed position.

Referring now in more detail to the figures in which like reference numerals identify corresponding parts, FIG. 1 is a perspective view of an embodiment of a carton 100 with at least one dispensing hole 201 (FIG. 2) in a closed position. The carton 100 includes top, front, left side, rear, right side, and bottom walls 105, 110, 115, 120, 125, 130, respectively. The top wall 105 includes a handle hole 135 where a handle 505 (FIG. 5) protrudes there from. The handle 505 can be used to lift the carton 100, containing a plastic bag filled with detergent liquid, for example. The left and right side walls 115, 125 include cut-out handles 140 for carrying the carton and bag that are positioned near the top wall 105 and substantially in the middle of the left and right side walls 115, 125. The rear wall 120 includes locking tabs 145 and locking slots 150 in the center top panel 210 to secure this panel to the rear wall 120. The locking tabs 145 are foldably attached at line 149 to the rear wall 120.

Figure 2:
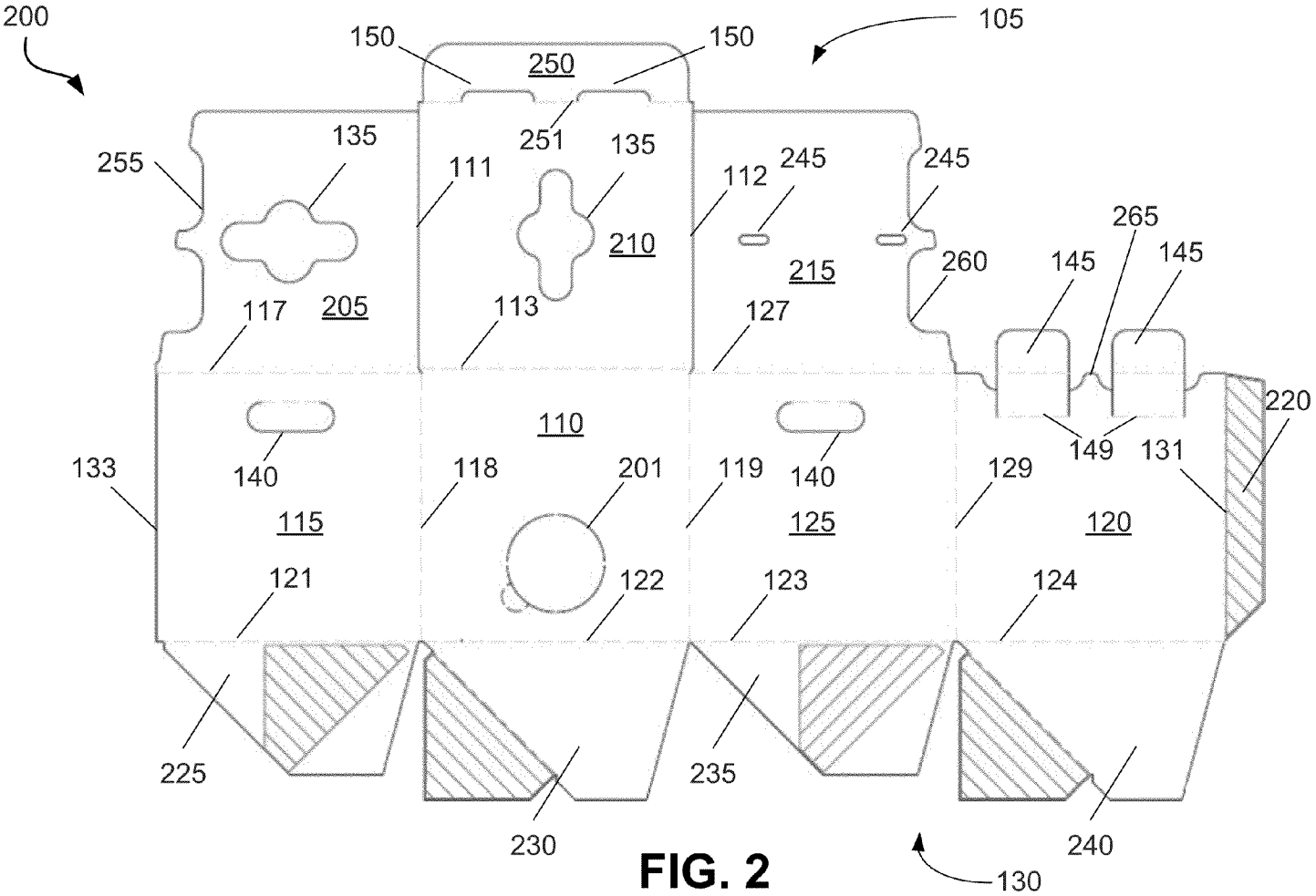
FIG. 2 is a top view of an embodiment of a blank for a carton with at least one dispensing hole, such as that as shown in FIG. 1.

FIG. 2 is a top view of an embodiment of a blank 200 for a carton 100 with at least one dispensing hole 201, such as that as shown in FIG. 1. The top wall 105 includes three top panels, a left top panel 205, a center top panel 210, and a right top panel 215 that facilitate supporting the handle 505 (FIG. 5) placed on the top wall 105. The three top panels 205, 210, 215 are separated by cut lines 111, 112.

The three top panels 205, 210, 215 are foldably attached to the left side wall 115, front wall 110, and right side wall 125 at fold lines 117, 113, 127, respectively. The left side wall 115, front wall 110, right side wall 125, rear wall 120, and flap 220 are foldably attached to each other at fold lines 118, 119, 129, 131, respectively. The flap 220 is attached, by glue or other attaching means, at the edge 133 of the left side wall 115 to erect the carton 100.

The left side wall 115, front wall 110, right side wall 125, rear wall 120, and flap 220 are foldably attached to interlocking flaps 225, 230, 235, 240 at fold lines 121, 122, 123, 124, respectively. The interlocking flaps 225, 230, 235, 240 can be folded to interlock onto each other to form a bottom wall 130, such as that shown in FIG. 4. These interlocking flaps can be secured together by their interlocking each other or by glue.

The top panels 205, 210 include a handle hole 135 that is configured for the handle 505 to pass there through. The top panel 215 include two handle slots 245 where the ends 305 (FIG. 3) of the handle 505 are passed there through such that the ends engage the top panel 215 to prevent the ends of the handle 505 from passing back out of the two handle slots 245. The engagement of the ends of the handle 505 allows a user to use the handle 505 for lifting the carton 100 with a filled plastic bag with the user's hand. The front wall 110 includes a cut-out dispensing hole 201 in which a dispensing device 1205 (FIG. 12) connected to a plastic bag that is filled with detergent liquid protrudes there from. The left and right side walls 115, 125 include partially cut-out handles 140 that can assist a user to lift the erected carton 100.

The top panel 210 is also foldably attached to a flap 250 at fold line 251 that can be positioned between the cut-out locking edges 255, 260 of the top panels 205, 215 and cut-out locking edge 265 of the rear wall 120. The flap 250 includes cut-out slots 150 that are passed there through by the locking tabs 145 which are foldably attached to the rear wall 120.

Figure 3:
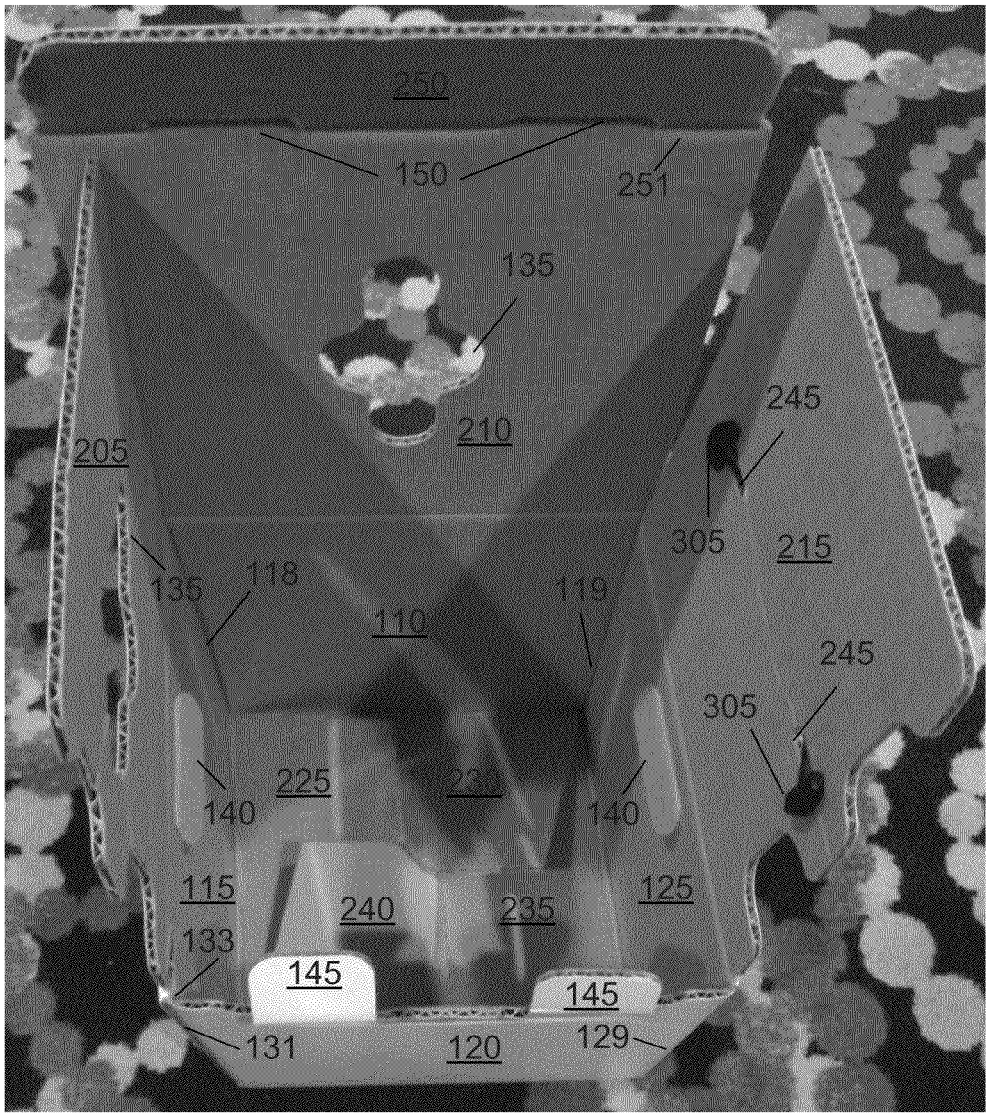
FIG. 3-8 are pictorial diagrams illustrating the formation of the carton with at least one dispensing hole from a blank to an erected carton, such as shown in FIG. 1.

FIG. 3-8 are pictorial diagrams illustrating the formation of the carton with at least one dispensing hole from a blank to an erected carton 100, such as shown in FIG. 1. FIG. 3 shows that the blank 200 is folded at fold lines 118, 119, 129, 131. The top panel 215 is attached with a handle 505 (FIG. 5) by way of slots 245. In this example, the ends 305 of the handle 505 are passed through the slots 245. The ends 305 of the handle 505 include a flange that has a width larger than the width of the slots 245 such that the ends 305 are prevented from passing back out of the slots 245.

Figure 4:
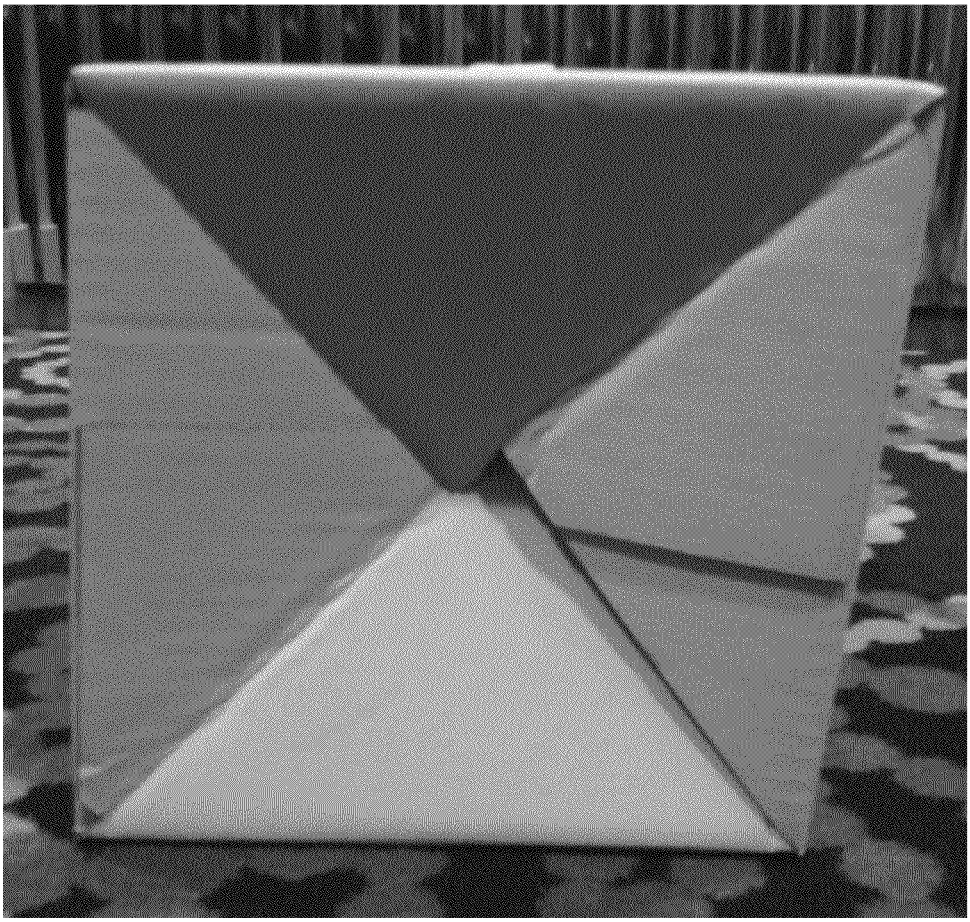

As shown in FIG. 2, the flap 220 is attached at the edge 133 of the left side wall 115 by way of adhesive, staple, or any other attachment means. The flap 250 is folded at fold line 251 such that the cut-out slots 150 are formed. The interlocking flaps 225, 230, 235, 240 are folded to interlock onto each other to form a bottom wall 130. The interlocking flaps 225, 230, 235, 240 enable the carton 100 to have a foldable/collapsible bottom that will withstand the weight of approximately 25-30 pounds of liquid detergent, which is approximately 2.75 to 3 gallons, for example. The interlocking flaps 225, 230, 235, 240 forming the bottom wall 130 are shown in FIG. 4.

Figure 5:
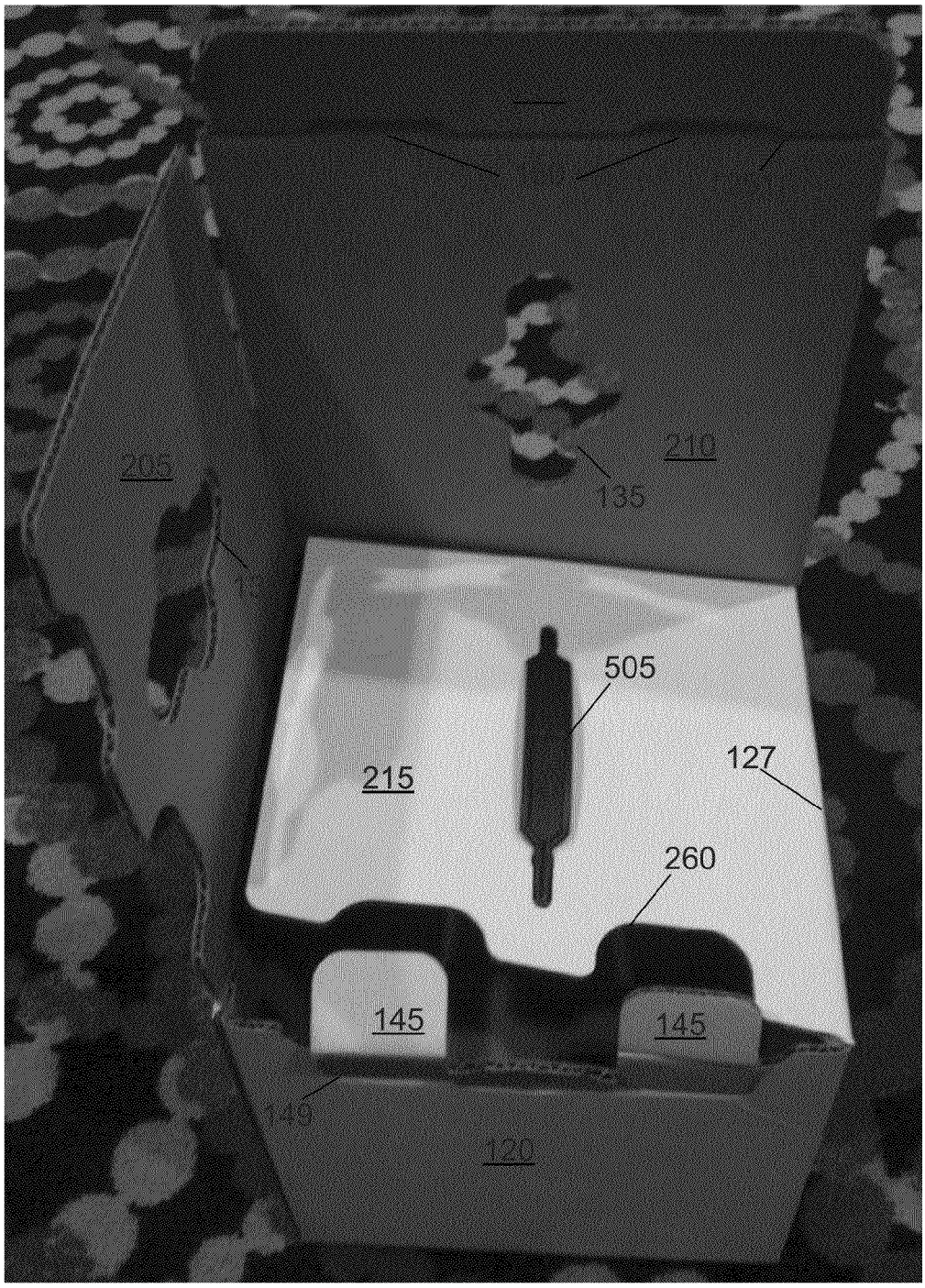

FIG. 5 shows that the top panel 215 is folded at fold line 127. The locking tabs 145 are folded at fold lines 149. The cut-out locking edge 260 of the top panel 215 substantially confirms to the shape of the locking tabs 145 for better ease in erecting the carton 100 and reducing the possibility of snagging the locking tabs 145 as the top panel 215 is folded towards the left top panel 205.

Figure 6:
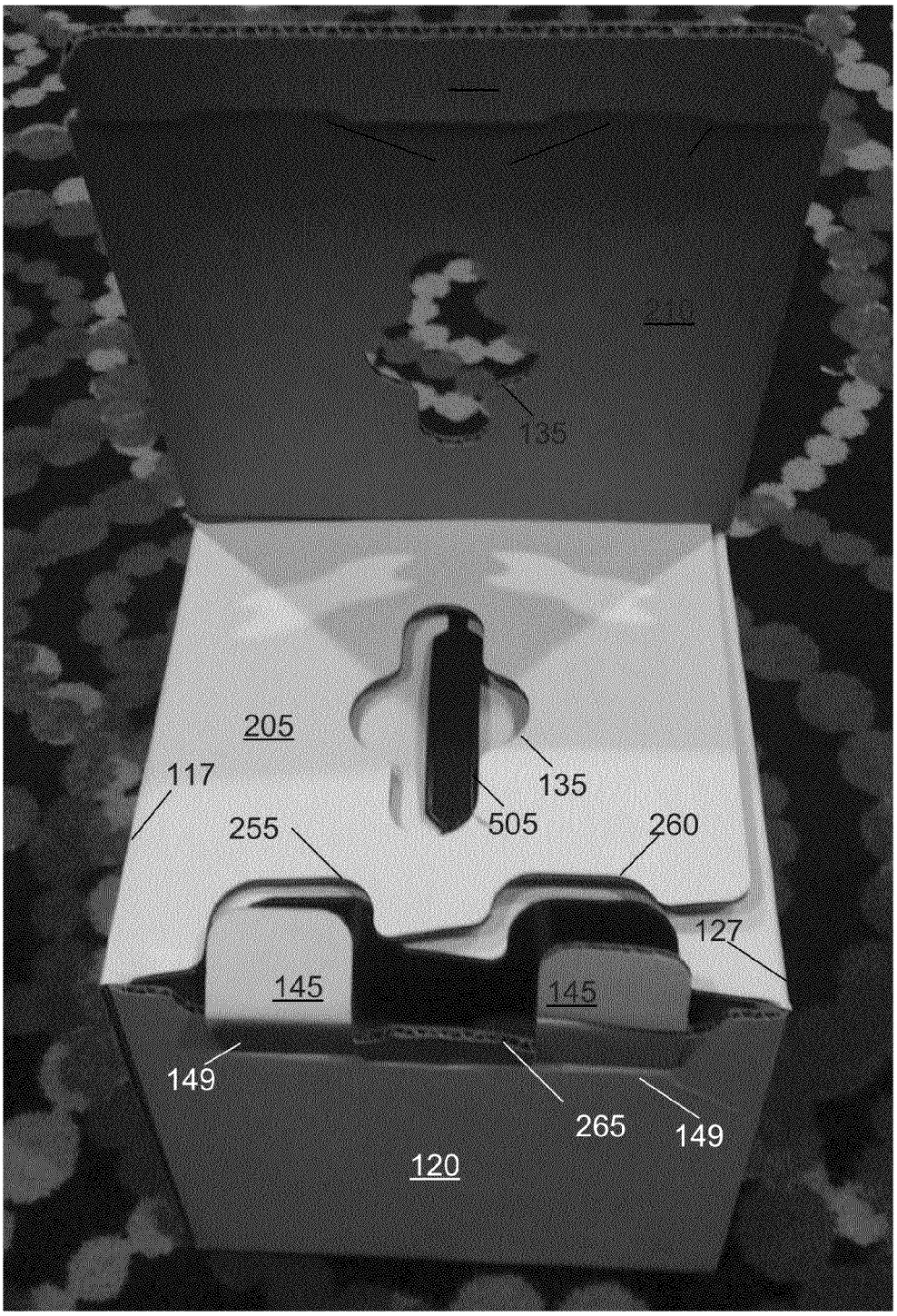

FIG. 6 shows that the left top panel 205 is folded at fold line 117. The cut-out locking edge 255 of the top panel 205 substantially conforms to the shape of the locking tabs 145 for better ease in erecting the carton 100 and reducing the possibility of snagging the locking tabs 145 as the right top panel 215 is folded towards the left top panel 205. The handle hole 135 is positioned substantially above the handle 505 to allow the handle 505 to pass there through.

Figure 7:
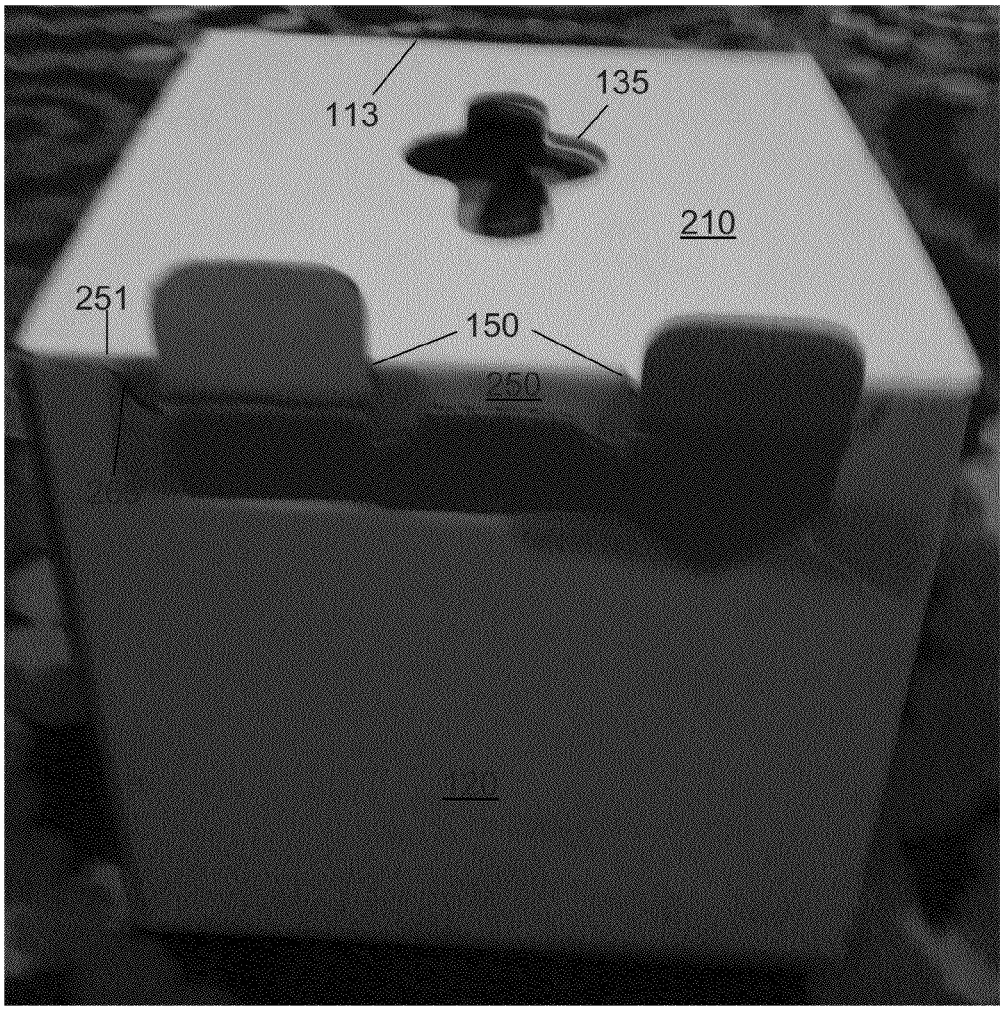

FIG. 7 shows that the left top panel 205 is folded at fold line 117. The flap 250 is positioned between the cut-out locking edges 255, 260 of the top panels 205, 215 and cut-out locking edge 265 of the rear wall 120. The handle slots 245 are positioned on the right top panel 215 that are slightly beyond (lengthwise) the handle holes 135 of the top panels 205, 210. As the user lifts the carton 100 using the handle 505, the ends 305 of the handle 505 are directly supported by the top panels 215, 205, 210. More specifically, the upward force (not shown) of the ends 305 as the carton 100 is lifted using the handle 305 is met with the horizontal support structure of the top panels 205, 210, 215.

Figure 8:
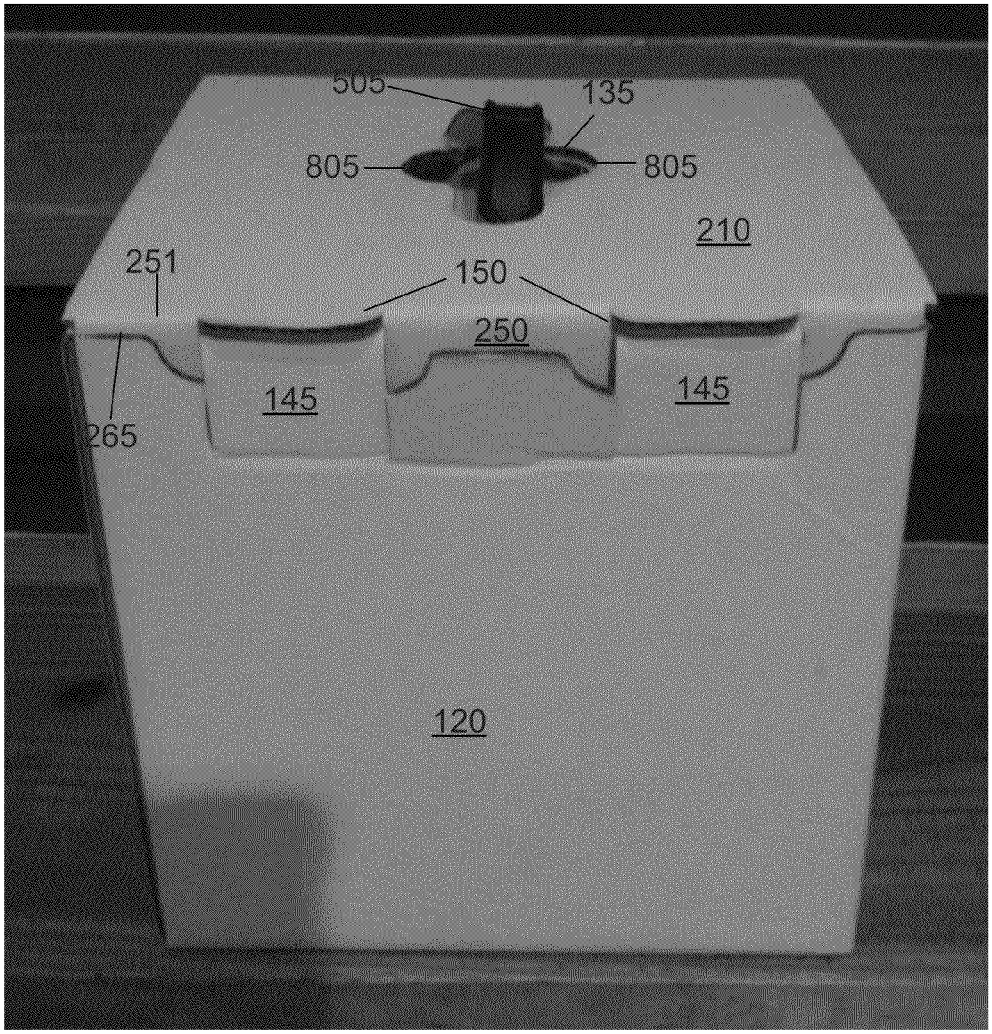

FIG. 8 shows that the locking tabs 145 is passed through the cut-out slots 150 that are formed by folding the flap 250 at fold line 251. The handle holes 135 can also include an access cut-out portion 805 that enables the fingers of the user to have access to the handle 505. The access cut-out portion 805 is positioned substantially in the middle of the handle hole 135 lengthwise.

Figure 9:
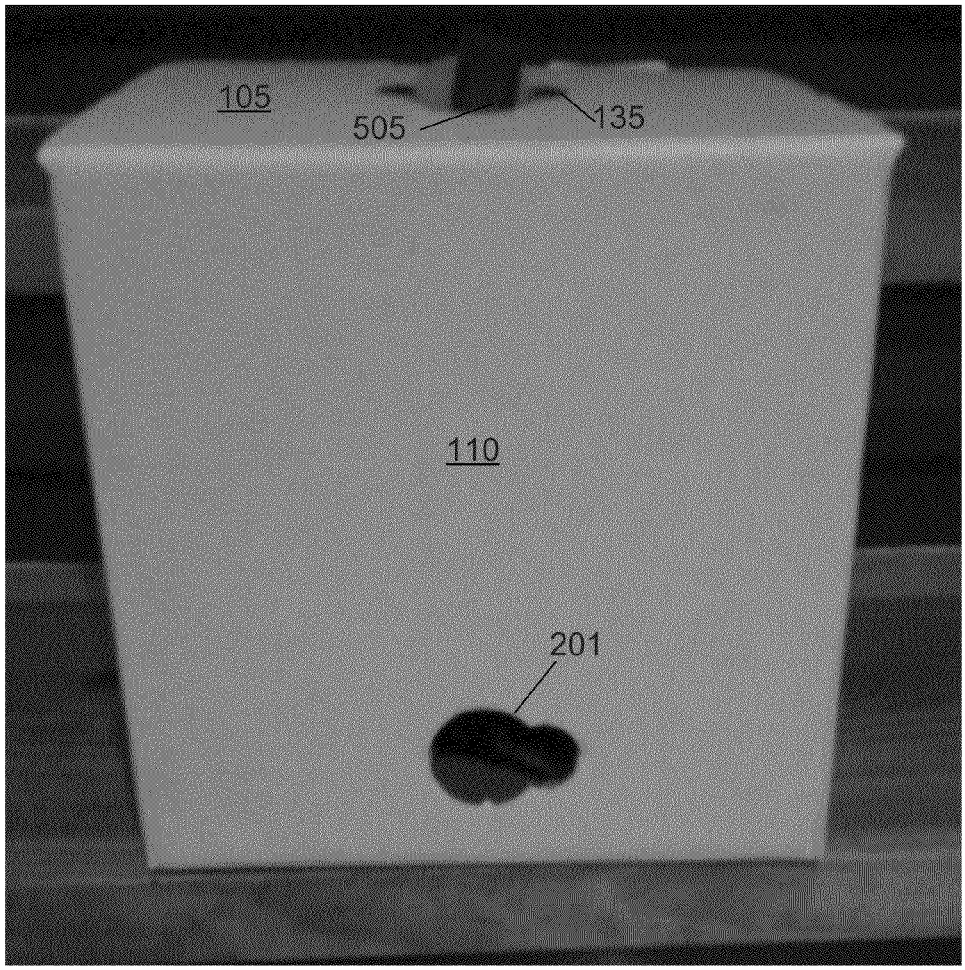
FIG. 9 is a front view of an embodiment of a carton with at least one dispensing hole, such as that as shown in FIG. 1.
Figure 10:
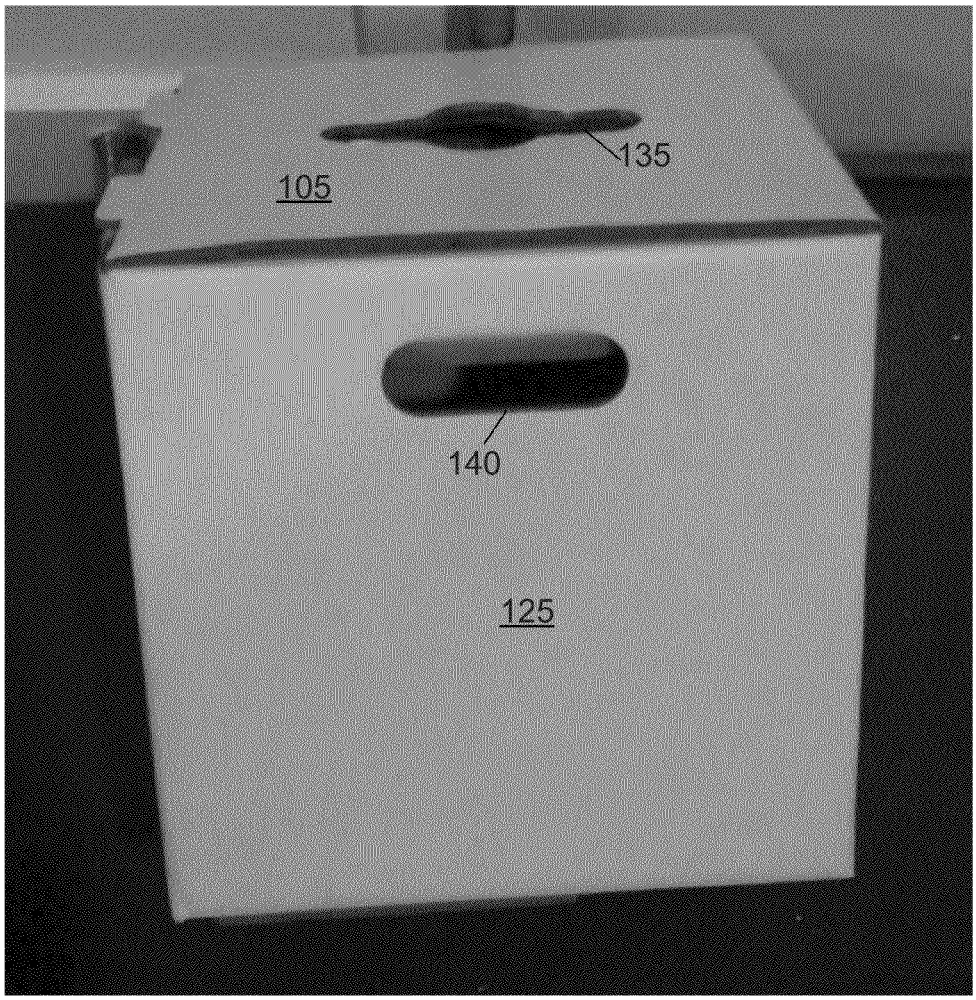
FIG. 10 is a right side view of an embodiment of a carton with at least one dispensing hole, such as that as shown in FIG. 1.
Figure 11:
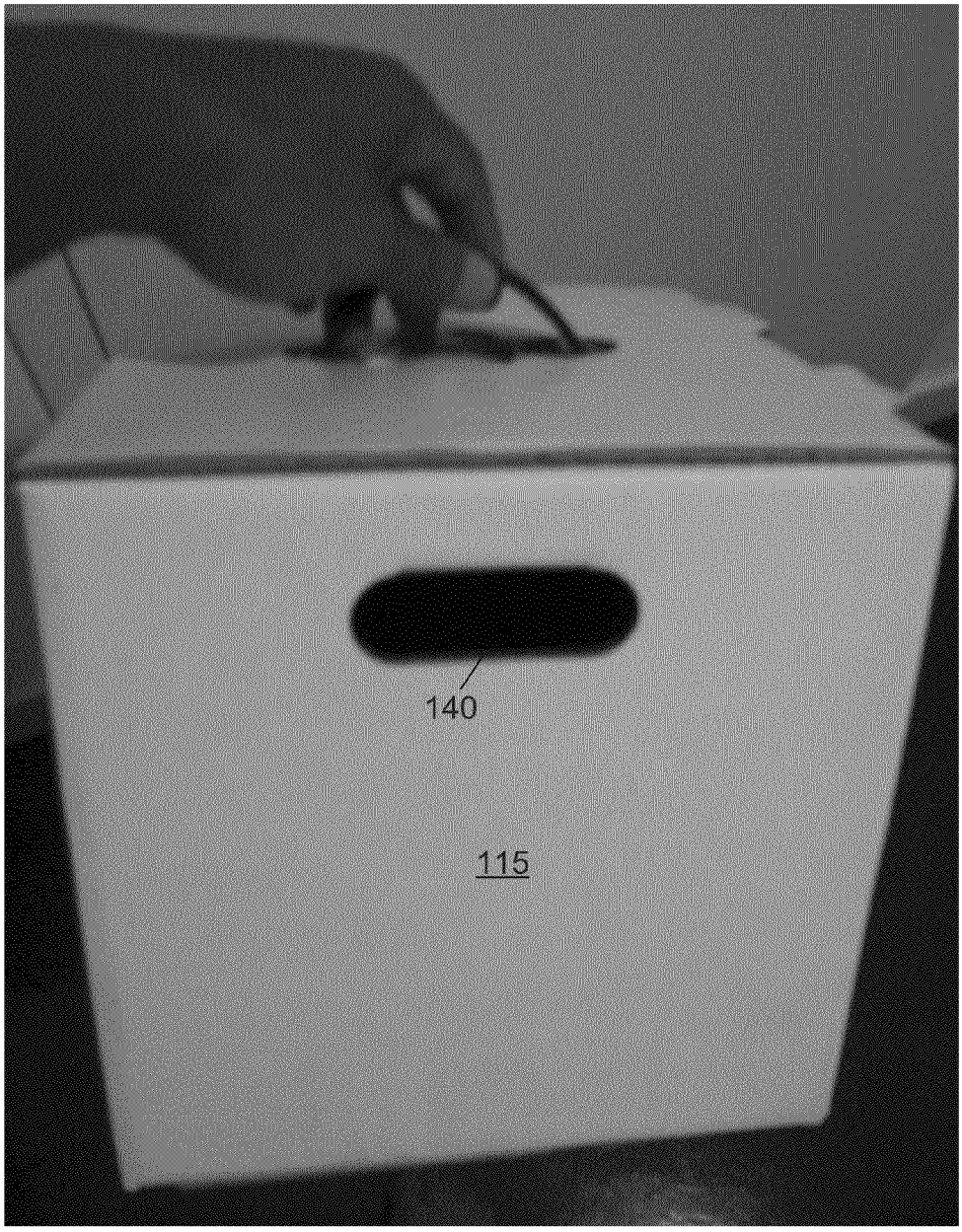
FIG. 11 is a left side view of an embodiment of a carton with at least one dispensing hole, such as that as shown in FIG. 1.

FIG. 9 is a front view of an embodiment of a carton 100 with at least one dispensing hole 201. FIG. 10 is a right side view of an embodiment of a carton 100 having a handle 140 on the right side wall 125. FIG. 11 is a left side view of an embodiment of a carton 100 having a handle 140 on the left side wall 115.

Figure 12:
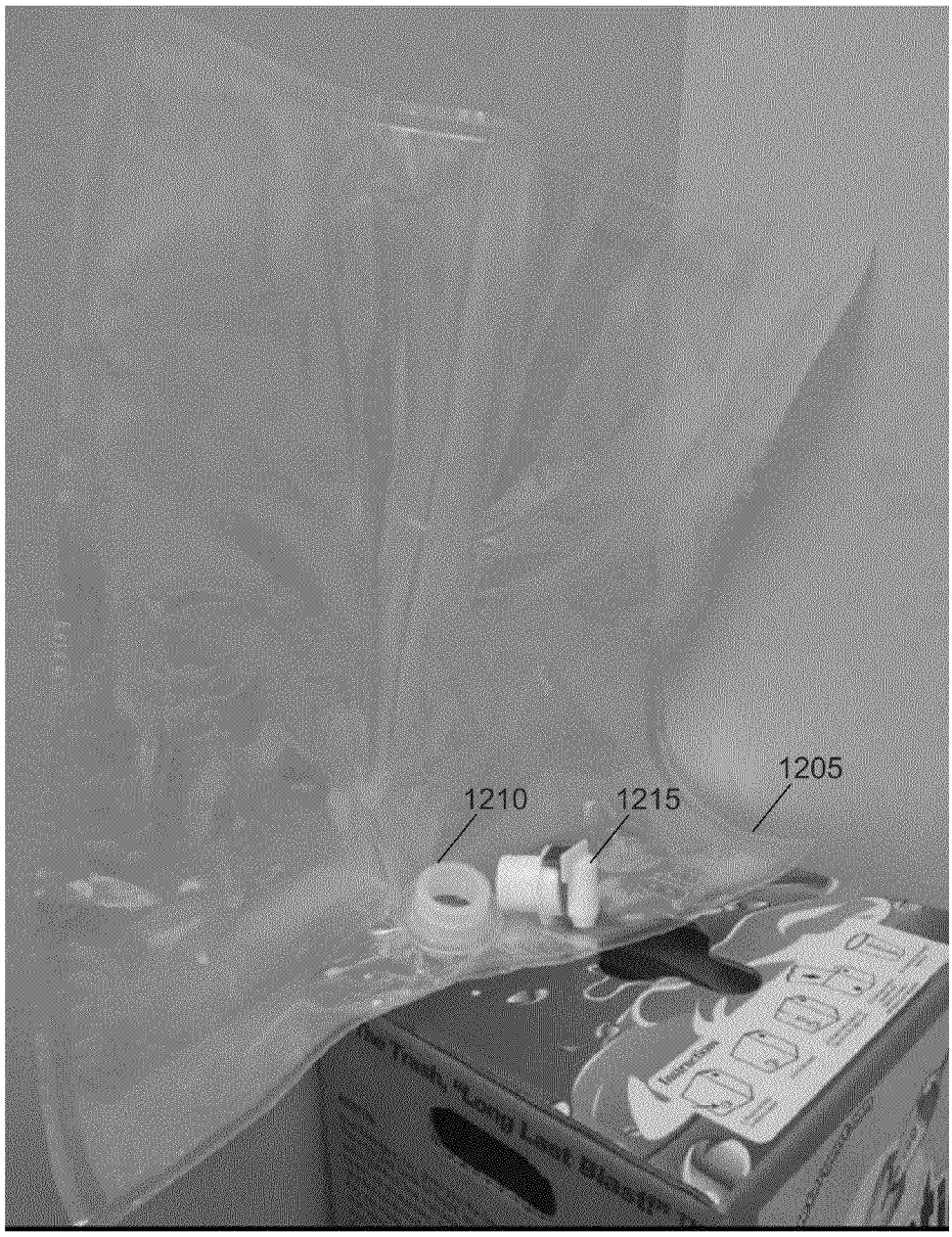
FIG. 12 is a perspective view of an embodiment of a preassembled dispensing device and a plastic bag.

FIG. 12 is a perspective view of an embodiment of a pre-assembled dispensing device 1215 and a plastic bag 1205. The plastic bag 1205 is coupled with a female coupler 1210 that is attached to an opening of the plastic bag 1205. The female coupler 1210 is sealed to be leak proof. The proximal end of the dispensing device 1215 slides into the opening of the female coupler 1210 and is leak-proof sealed. One skilled in the art can appreciate the various mechanisms of making the dispensing device 1215 leak-proof. In this example, the proximal end of the dispensing device 1215 include a series of protruding rings (not shown) such that the rings aligns with recess rings (not shown) of the female coupler 1210. The plastic bag 1205 with the dispensing device 1215 can be assembled and filled with detergent liquid. The filled plastic bag 1205 and possibly a measuring cup (not shown) are packaged in the carton 100. The plastic bag 1205 can be a cube-shaped or any other geometric shape. The dispensing device 1215 protrudes out of the carton 100 through the dispensing hole 201 (FIG. 9). The plastic bag 1205 is recyclable.

The carton 100 is designed to withhold up to 25 to 30 pounds of materials, e.g., detergent liquid, inside the carton 100. The carton 100 can be smaller or larger size to hold less or more than 25-30 pounds of materials. The carton 100 has a refillable bag 1205 in which the customer can bring/send back the bag 1205 to a distributor, for example, who can refill the bag.

Figure 13:
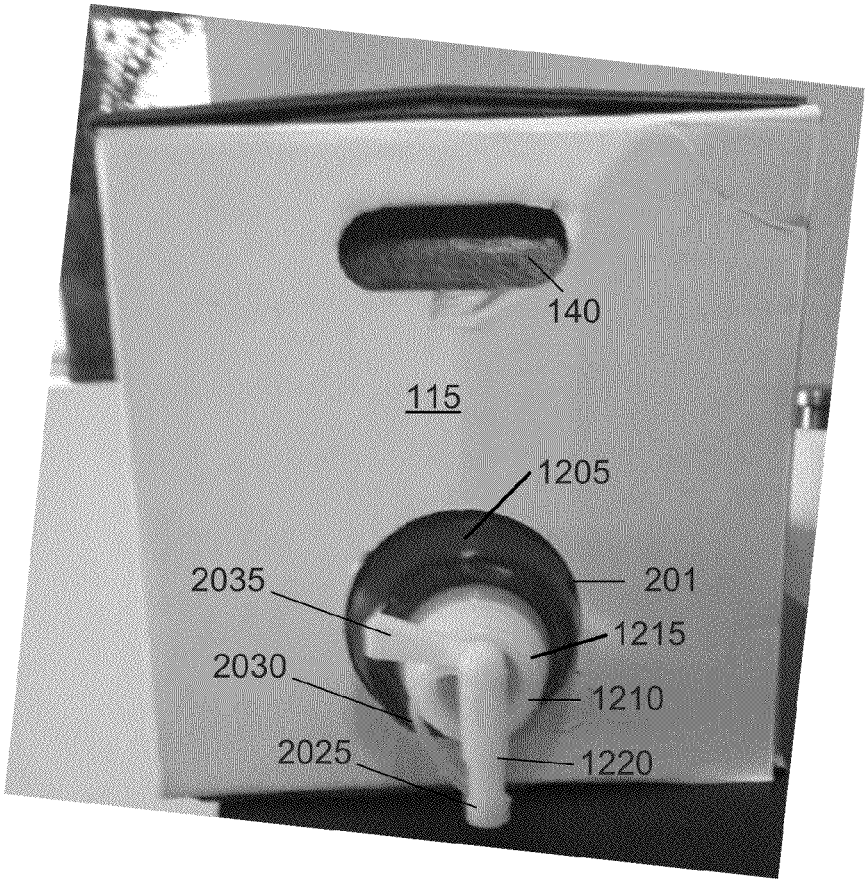
FIG. 13 is the view of the left side wall of a carton containing a plastic bag in accordance with an embodiment of the present invention.

FIG. 13 is the view of the left side wall 115 of a carton containing a plastic bag 1205. The handle 140 and the aperture 201 for the dispensing device 1215 are both located in the left side wall 115. A dispensing device 1215 with a valve 1210 and spout 1220 are shown with a cap 2025 to help prevent small leaks from the bag 1205. The cap 2025 is attached to a link 2030 that is also attached to the valve 1210. The spout 1220 is opened and closed using a lever 2035.

Figure 15:
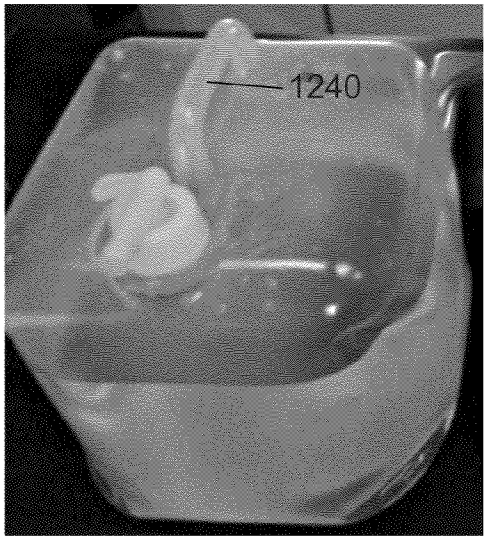
FIG. 15 is a perspective view of an embodiment of a bag having a spout and a handle.
Figure 14:
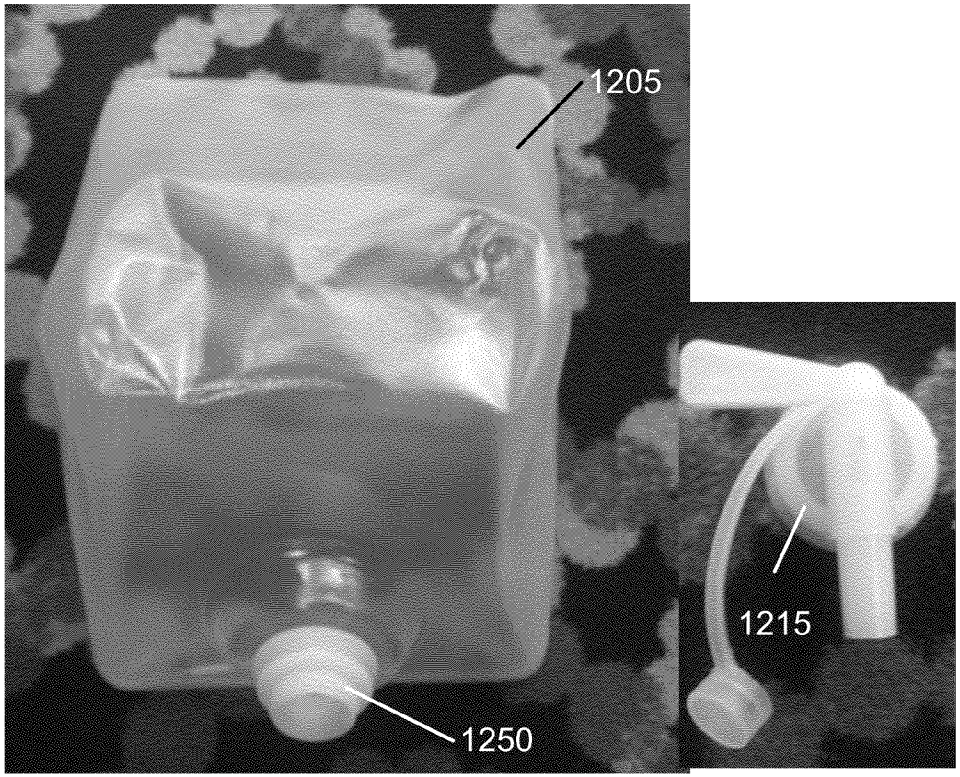
FIG. 14 is a preassembly of a bag having a spout coupler in which a spout can be attached thereto.

FIG. 14 is a preassembly of a bag 1205 having a spout coupler 1250 in which a spout 1215 can be attached thereto. The bag 1205 is, in this example, shaped in a cube to fit tightly in the carton 100 and having a dispensing opening that is attached to the spout coupler 1250. The spout 1215 is screwed onto the spout coupler 1215. In one embodiment, the bag 1205 can be coupled to the spout coupler 1250 such that the bag 1205 does not have a dispensing opening. As such, the spout coupler 1215 can include a bar that punctures the bag 1205, forming the dispensing opening as the spout coupler 1215 is being screwed onto the spout coupler 1250. Alternatively or additionally, the bag 1205 can have a handle 1240 for carrying the bag and carton, such as that shown in FIG. 15. The bag can also have an opening with a cap, for example, on top of the bag for refilling with liquid.

The blank 200 can easily be erected into a carton 100 by folding the various fold lines. First folding fold lines 118, 119,129 and also 111 and 112 results in forming a box structure. Folding fold lines 121, 122, 123 and 124 will allow interlocking flaps 225, 230, 235 and 240 to be interlocked to form the bottom of the carton 100. These flaps can be glued to secure a strong bottom to support the bag 1205 with product. Locking flap 220 can be attached by glue to the edge 133 of left side wall 115. This locking flap can be attached to left side wall 115 by locks formed within the blank itself. The bag 1205 with product inside can be lowered into the carton 100 so that the dispensing device 1215 extends partially through aperture 201. The ends 305 of a handle 505 can be inserted into handle slots 245 in right top panel 215 which can be folded on fold line 127 and left top panel 205 is folded along fold line 117 and center top flap 210 is folded along fold line 113 to complete the top structure of the carton 100. In the process locking tabs 145 can be inserted into locking slots 150 to secure the top structure. Flap 250 is folded down inside of flap 265. These various flaps securing the top structure can be undone to refill the bag with product if the bag has a refill aperture.

A Blast Detergent, Inc dispensing machine in grocery stores and the likes can dispense specific amounts of liquid detergent, based on the customer's selection at the machine. The customer can bring their own container, or own Blast Detergent carton 100, or they can purchase a carton 100 from the machine. It will be an option on the machine. The machine will offer various liquid detergents available through Blast Detergent dispensing machine It should be emphasized that the above-described embodiments of the present invention, particularly, any "preferred" embodiments, are merely possible examples of implementations, set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

I claim:

1. A paperboard carton for carrying a flexible bag for holding a liquid product, the carton having a left side wall, connected to a front wall by a fold line, with the front wall connected to a right side wall by a fold line, with the right side wall connected to the rear wall by a fold line, which in turn is connected to a locking flap by a fold line, with the left side wall having an outside edge which is attached to the locking flap by attaching means, with each of the walls having a top and bottom, with bottom of each flap attached to interlocking flaps by a fold line, with the interlocking flaps forming the bottom of the carton, with the left side wall attached at its top to a left top panel by a fold line, with the top of the front wall attached to the center top panel by a fold line, with the top of the right side wall attached to a right top panel by a fold line and the rear wall attached to a pair of locking tabs by a fold line, with the center top panel having a top attached to a flap by a fold line, with the flap having a pair of locking slots into which the locking tabs are secured, with left top panel, center top panel and right top panel being folded to form the top of the carton, with the bottom of one of the side walls having an aperture for receiving a dispensing mechanism on the bag, wherein a flexible bag holding a liquid product is deployed, with the bag having a dispensing mechanism which projects through the aperture in the side wall for dispensing liquid, wherein the flexible bag includes a spout coupler in which a spout can be attached thereto, wherein the flexible bag has a dispensing opening that is attached to the spout coupler, wherein the spout coupler includes a bar that punctures the bag, forming the dispensing opening as the spout coupler is being attached to the spout coupler, wherein the spout includes a cap that couples to a dispensing end of the spout to help prevent small leaks from the bag and the cap is attached to a link that is attached to spout.

2. The paperboard carton of claim 1 in which the attaching means for attaching the locking flap to the outside edge of the left side wall is glue.

3. The paperboard carton of claim 1 in which the attaching means for attaching the locking flap to the outside edge of the left side wall are locks formed in the paperboard which lock the locking flap to the left side wall.

4. The paperboard carton of claim 1 in which there are apertures in the top panels for a handle and means to secure the handle to the top panels.

5. The paperboard carton of claim 1 in which the flexible bag has a top and bottom, with a handle on the top which projects through apertures in the top panels for carrying the carton with bag containing the liquid product.

* * * * *